US007475574B2

(12) United States Patent
Grimm et al.

(10) Patent No.: US 7,475,574 B2
(45) Date of Patent: Jan. 13, 2009

(54) WASHING MACHINE WITH SENSOR MEANS

(75) Inventors: Dieter Grimm, Bretzfeld-Brettach (DE); Robert Huettner, Bochum (DE)

(73) Assignee: Whirlpool Corporation, Benton Harbor, MI (US)

( * ) Notice: Subject to any disclaimer, the term of this patent is extended or adjusted under 35 U.S.C. 154(b) by 550 days.

(21) Appl. No.: 10/543,199

(22) PCT Filed: Jan. 14, 2004

(86) PCT No.: PCT/EP2004/000199

§ 371 (c)(1),
(2), (4) Date: Jul. 22, 2005

(87) PCT Pub. No.: WO2004/065681

PCT Pub. Date: Aug. 5, 2004

(65) Prior Publication Data

US 2006/0070409 A1 Apr. 6, 2006

(30) Foreign Application Priority Data

Jan. 22, 2003 (EP) ..... 03001274

(51) Int. Cl.
*D06F 33/00* (2006.01)

(52) U.S. Cl. ..... 68/12.05; 68/12.02; 68/12.19; 68/12.21; 68/24

(58) Field of Classification Search ..... 68/3 R, 68/12 R, 12.02, 18 D, 23.2, 207, 12.05, 12.19, 68/12.21, 24
See application file for complete search history.

(56) References Cited

U.S. PATENT DOCUMENTS

2005/0081572 A1 * 4/2005 Park et al. ..... 68/12.02
2005/0081574 A1 * 4/2005 Lyu et al. ..... 68/12.26

FOREIGN PATENT DOCUMENTS

| | | | |
|---|---|---|---|
| DE | 3236291 | A1 | 4/1984 |
| DE | 4311064 | A1 | 10/1994 |
| EP | 1441056 | A1 * | 7/2004 |
| GB | 1581330 | | 12/1980 |
| JP | 1022297 | A | 1/1989 |
| JP | 2126894 | A | 5/1990 |
| WO | 02/50498 | A1 | 6/2002 |

* cited by examiner

*Primary Examiner*—Michael Barr
*Assistant Examiner*—Rita R Patel
(74) *Attorney, Agent, or Firm*—Clifton Green; Michael D. Lafrenz

(57) ABSTRACT

A washing machine comprises a tank for loading washing fluid and items to be washed and a control adapted to carry out a predetermined washing program. The washing machine comprises a first electrode electrically insulated from the washing fluid and a sensor connected to the first electrode for detecting a value of a sensor formed by the first electrode and by the washing fluid acting as a second electrode, the value being fed to the control in order to control and/or adjust the washing program.

11 Claims, 3 Drawing Sheets

WASHING MACHINE WITH SENSOR MEANS

BACKGROUND OF THE INVENTION

1. Field of the Invention

The present invention relates to a washing appliance comprising a tank for loading washing fluid and items to be washed and a control adapted to carry out a predetermined washing program.

2. Description of the Related Art

Washing appliances, for instance washing machines or dishwashers, carry out a program selected by the user on the basis of the amount and degree of soil of items. With the term "washing program" we mean hereby the entire program carried out by the appliance or a portion thereof. Usually, in the case of a laundry washing machine, the washing program comprises also the rinsing and spinning steps. Some washing appliances have sensors for detecting automatically the load and other parameters in order to self-adjust the washing program.

SUMMARY OF THE INVENTION

It is an object of the present invention to provide a washing appliance having a detection system able to assess the working condition thereof in a reliable and economical matter, and for assuring a self-adjustment of the washing process. According to the present invention, the appliance comprises at least a first electrode electrically insulated from the washing fluid and a sensor connected to the control and to the first electrode and adapted to detect a value of a sensor formed by the first electrode and by the washing fluid acting as a second electrode, the value being fed to the control in order to control and/or adjust the washing program. The sensor and the control can be parts of a single electronic control unit. The value detected by the sensor is indicative of a capacitance and/or a complex impedance of the two electrodes.

DESCRIPTION OF THE PREFERRED EMBODYMENT

In a preferred embodiment of the invention, the sensor essentially constitutes a capacitor. The first electrode is preferably a metal plate isolated from the washing fluid by a dielectric, for instance the insulating wall of the tank made of polymeric material. The second electrode of the capacitor is formed by the washing fluid (wash fluid in the tank or receptacle). The electrical connection between the detector and the washing fluid is made through a metal body, for instance through the heating element body. The first electrode is spatially arranged so that wetting with washing fluid of the respective dielectric can occur. Preferably the first electrode is above the fluid level of the washing fluid as the temporarily applied fluid film can run off there.

In the case of a plastic tub the dielectric can be the tub itself, and the first electrode surface may then be arranged at various locations on the exterior of the tub or inserted in various locations into the tub wall respectively. The embodiment in which the first electrode is integral with the tub wall (for instance through a process of co-injection during the injection molding of the plastic tub) also provides a variety of functional benefits: simultaneous attachment of the electrodes prevents conductive contact of the electrode with potential impurities on the exterior of the tub (dirt buildup on the exterior of the tub, water condensation on the exterior of the tub, it reduces the distance between the metal or permanent electrode plate and the electrode sheet formed by the fluid film and subsequently increases the sensitivity of the electrode system).

The dielectric and the first (permanent) electrode can be arranged not only in the tub, but also in the drain tube or in an external chamber that is wetted by a specially controlled pump. The first electrode can be composed by several distinct electrodes geometrically arranged in the case of the plastic tub that electrically isolates and acts as a dielectric, or in a plastic tube (in which the washing fluid flows) on the exterior thereof and/or with electric insulation also within the tub or tube respectively. In the case of an electrically conductive tank, e.g. a stainless steel tank, the capacitive sensor may be realized completely within the tank or completely outside the tank respectively.

The spatial arrangement is always chosen thereby such that through controlled wetting of the dielectric with fluid (e.g. by drum movement, or by a special pump) the result is a ground electrode with a variable surface. The film, which is the result of controlled wetting, (variable plate capacitor in the area of the permanent electrode) then runs off in the gravitational field after controlled wetting on account of the spatial arrangement. In addition, wetting can be intentionally interrupted, for example, by the pump or the drum movement in order to record the runoff flow in terms of time. The variation in the signal from the capacitive sensor gives information on the detergent concentration, the degree of rinsing and other important parameters which may be used to control the washing program.

Furthermore, wetting by the drum can also occur continuously, e.g. by the wash fluid entrained by the drum at a certain rotation speed and the runoff of the wash fluid on the receptacle wall, so that an equilibrium can be reached and a constant wash fluid level is achieved. The height of this level depends on the properties of the wash fluid. The resulting signal (capacity) is indicative of the mechanical properties of the boundary layer of the wash fluid on the sensor surface based on the runoff process on the sensor surface, and/or on an arbitrary surface, like fiber surfaces, for example, when washing and rinsing clothes. It is known that the mechanical properties of the boundary layer influence the washing process of fibers and/or arbitrary surfaces and the rinse process of fibers and/or arbitrary surfaces. Subsequently, it can be used in part to monitor wash and rinse processes and to actively control by an adjustment process. The progression of such processes can be made visible through a display in the user field area.

The sensitivity of the signal is set by the size of the sensor surface and/or its arrangement. Vertical arrangement of the first sensor is preferred for the signal during the washing process. A flatter arrangement is better during rinsing, since with increased rinsing action the fluid and/or film runs off more easily. In order to have always the best arrangement in different steps of the appliance cycle, different permanent electrode surfaces can thus be compiled into one multifunctional sensor. According to such embodiment, the first electrode can be divided into individual segments of known geometric arrangement. Subsequently, an arbitrary characteristic diagram curve can be plotted through targeted arrangement of the individual condenser components.

If the individual electrode segments are wetted from bottom to top as it may happen in a tub of an horizontal axis washing machine, for example by drum movement, than one obtains a discreet step signal, the traits of which can clearly be assigned to "levels" and/or a wetted sensor surfaces, as the surfaces and/or the sensor data of the individual components are known. This makes automatic calibration possible with software, which can be repeated as desired when the characteristic signal is attained. The distribution of the electrodes into segments also allows the electrode segments to be mounted in other places, e.g. to record the fluid column upstream from the discharge pump in order to be able to control turning the pump on and off in order to prevent air sounds in the pump, for example.

The first electrode surface should be arranged such that the film running off on its dielectric is influenced the least possible by disturbances. A disturbance can be a film running off from the above, for example. Using a shaped deflector on the inside surface of the tub this undesired running off is avoided, since the deflector leads the fluid and/or fluid film from above past the relevant sensor surface. Disturbances can also occur due to films from softeners or other additives. For the sake of prevention, the sensor surface is preferably rinsed with freshwater. This special rinsing can be integrated into the program sequence such that after the softening cycle and/or after introduction of any additives the relevant surface of the sensor can be rinsed with the aid of a special chamber that can be filled with fresh water and subsequently purifies the film caused by the softener and/or additives. The whole sensor rinsing process can be repeated for control surveys.

The same device is used to differentiate suds from the film present during the wash process. Suds keep flowing again independently after rinsing and therefore usually cause the same signal. A wash-active film caused by the wash fluid is removed and/or weakened during rinsing. The signal returns only after active wetting, i.e. as described in the example above by rotation of the receptacle. The program control can evaluate this information and if necessary already optimize the program with special suds routines during the wash process.

It is preferred to integrate a reference capacity in the sensor which enables extensive elimination of temperature effects (temperature coefficient of different substances), life span drift by changing the substance and influences of various detergents, soil and water.

A sensor used in a washing machine according to the invention is simple and robust (no moving parts, conductive and isolating surfaces with integrated electronics) and it produces a signal already during washing that correlates with many parameters important for the wash and/or rinse and spin cycle:

- Under and/or over-proportioning of wash substances
- Changes (consumption) of wash activity of the fluid
- Concentration balance when rinsing
- Rinse effect, rinse result
- Occurrence of foam/suds during the wash and rinse process
- End of rinse
- Reference level when water flows in
- Spray water when spinning By already having these parameters during operation, further washing program optimization is made possible together with already known parameters, in particular:

- Automatic proportioning and/or re-proportioning of detergents
- Ancillary automatic wash time adjustment of wash time for extreme soiling
- Partially regulated and/or automatic rinse process (time, water amount, quantity, mechanical system)
- Improved online display of the wash, rinse and spin programs
- Suds monitoring with active program change
- Indication: Under/over-proportioned, suds
- Controlled centrifuge turns
- Pump motor control

BRIEF DESCRIPTION OF THE DRAWINGS

The present invention is described in the following by way of example with reference to the accompanying drawings, in which.

DETAILED DESCRIPTION

Figure 2:
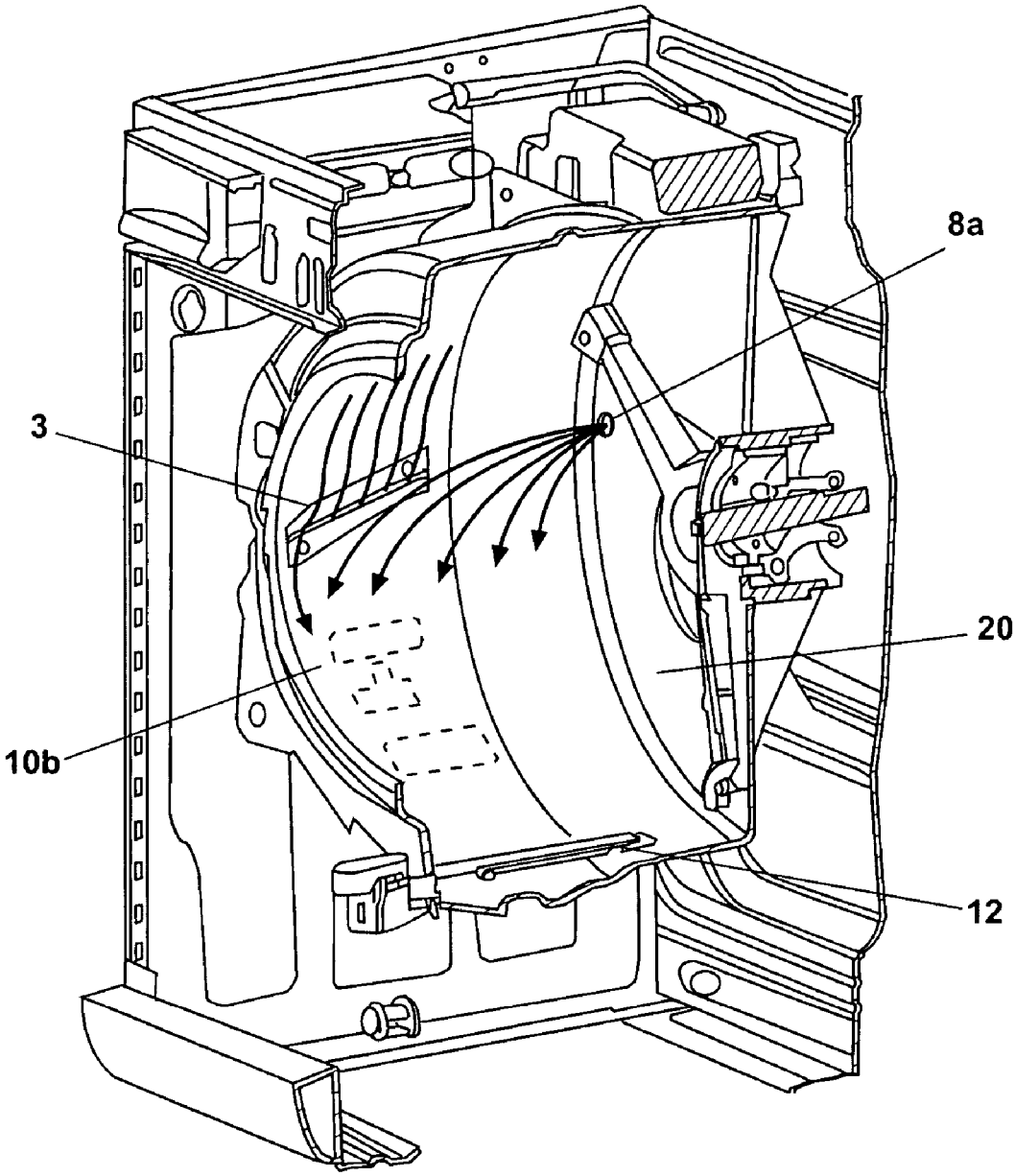
FIG. 2 is a perspective view of a section taken along line II-II of FIG. 1, in which the inside of the tub is shown.
Figure 3:
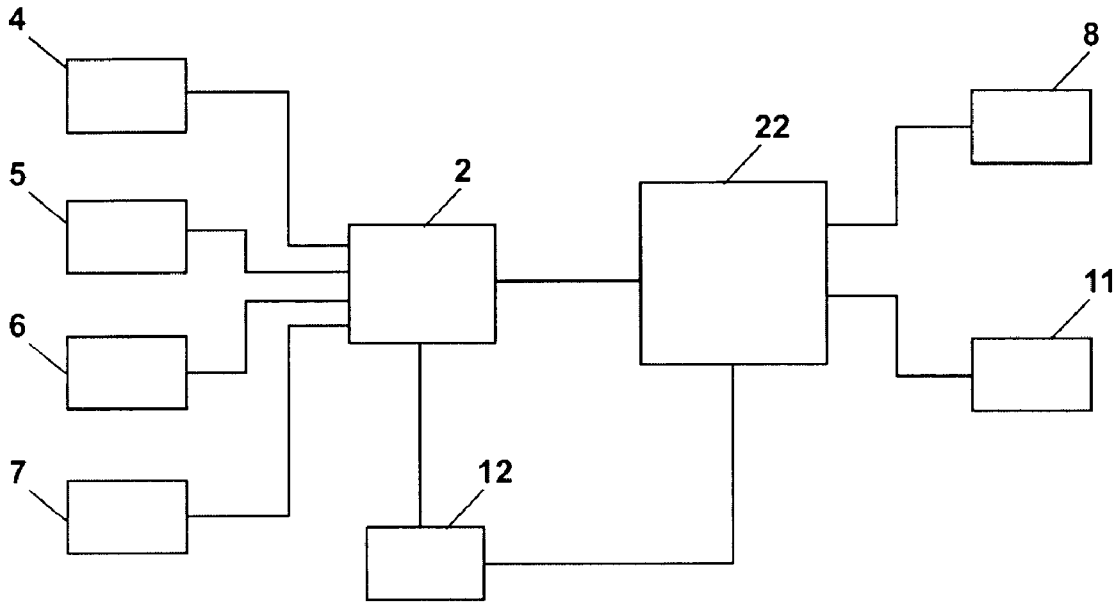
FIG. 3 is a schematic circuit diagram of a washing machine of FIGS. 1 and 2.

With reference to the drawings, a washing machine comprises a plastic tub 10 having an outside cylindrical surface 10*a*. In the plastic tub 10 there is provided a rotating drum (whose only the rear portion 20 is shown in FIG. 2) driven by a motor 11. The tub 10 is loaded with fresh water through valves 8 and through a detergent bin 9. On the outside surface 10*a* of the tub 10 there are placed three measuring electrodes 4-6 and a reference electrode 7. These electrodes are connected to an electronic unit 2, such unit being linked to a control process unit 22 of the washing machine (FIG. 3). The electronic unit is also linked to a heating element 12 placed in the tub, which is used also as electrical conductor in the washing fluid.

On the inside surface of the tub, indicated with the reference 10*b*, a deflector 3 is placed which acts as a fluid film tear-off device. The function of the deflector 3, which has an axis inclined with reference to the axis of the tub, is to channel the fluid coming down from the upper portion surface of the tub away from the zone where electrodes 4, 5 and 6 are placed, in order to avoid the already mentioned problem of disturbance.

Figure 1:
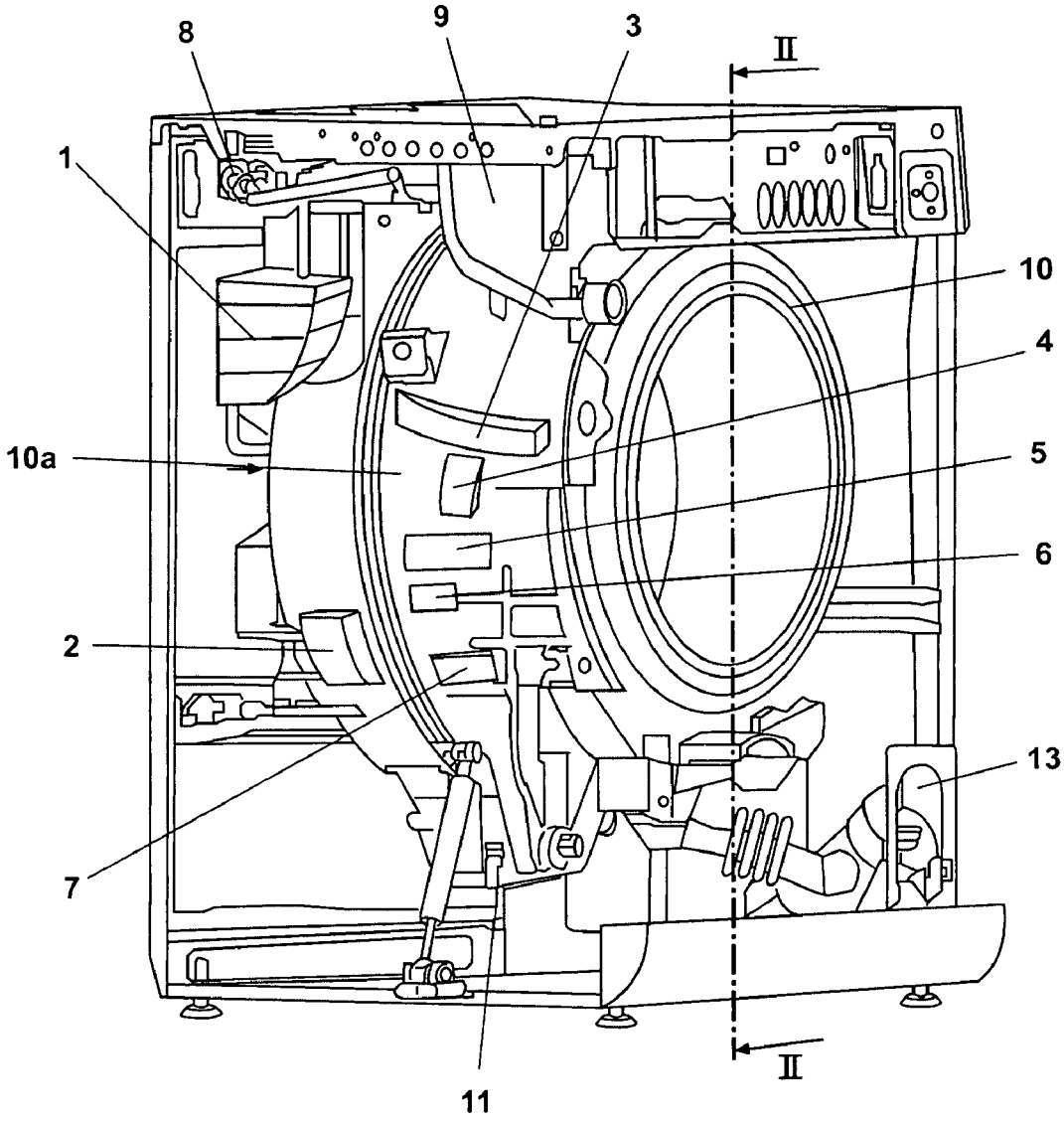
FIG. 1 is a perspective view of a partially sectioned washing machine according to the invention, in which the outside of the tub is shown.

For avoiding the other disturbance problem due to the use of softeners or additives, the tub 10 presents a fresh water inlet nozzle 8*a* (FIG. 2) fed by an external chamber 1 (FIG. 1). The nozzle 8*a* faces the sensor surface and continuously supplies a defined amount of water. When rinsing the sensor, it is crucial that the entire surface is rinsed. This is achieved in that more freshwater flows into the chamber 1 than flows off below via the nozzle 8*a*. Thus the chamber 1 fills with freshwater. Subsequently, increasing static pressure results and the water running off thus successively reaches the entire surface of the sensor. The freshwater is shut off when the chamber is full. The water flowing off again has increasingly less pressure and the stream gradually diminishes. The volume of the chamber 1 is designed such that in most cases it cleanses the sensor.

Even if in the above description reference was made to a measurement of capacitance, nevertheless expanded assessment of the capacitive sensor may include provisions for measuring its complex impedance, allowing further interpretations of the measurement signal. This allows an enhanced signal evaluation including vectorial evaluation of the impedance of the entire system subject to the frequency. It is to be expected that thin layers, films, fluid medium, powder and suds can be differentiated therewith.

According to the above features, a washing appliance according to the invention may assess many parameters of the wash program, as amount of detergent in wash and/or rinse water, soil amount in the wash water, wash activity of the wash water, rinse efficiency, suds and foams occurrence, and level of the wash water, these parameters being used for controlling and optimizing the wash program. Moreover, the signal form the sensor can be used to monitor of the discharge pump too.

We claim:

1. A washing appliance, comprising:

a tank for loading washing fluid and items to be washed; and a control adapted to carry out a predetermined washing program;

at least a first electrode electrically insulated from the washing fluid and located on the outside surface of the tank;

a deflector is placed on the internal cylindrical surface of the tank for protecting a zone corresponding to the first electrode from the washing fluid flowing from the upper portion of the tank; and a sensor connected to the control and to the first electrode and adapted to detect a value of a sensor formed by the first electrode and by the washing fluid acting as a second electrode, the value being fed to the control in order to control and/or adjust the washing program.

2. A washing appliance according to claim 1, wherein the value detected by the sensor is indicative of capacitance and/or complex impedance of the electrodes.

3. A washing appliance according to claim 2, wherein the tank is a cylinder having a substantially horizontal axis, wherein a plurality of electrodes are placed on the cylindrical surface of the tank in an intermediate position between the bottom and the upper portion of the tank.

4. A washing appliance according to claim 1, wherein a plurality of first electrodes are placed on the outside surface of the tank.

5. A washing appliance according to claim 4, wherein on the internal cylindrical surface of the tank a deflector is placed for protecting a zone corresponding to the plurality of first electrodes from the washing fluid flowing from the upper portion of the tank.

6. A washing appliance according to claim 1, wherein the electrical connection between the sensor and the washing fluid is made through a heating element or through an additional electrode placed in the tank.

7. A washing appliance according to claim 1, further comprising:

a reference electrode connected to the sensor and adapted to correct the value indicative of capacitance and/or complex impedance from external factors.

8. A washing appliance according to claim 1, further comprising:

a nozzle fed by a chamber placed outside the tank for cleaning an inside zone of the tank corresponding to a plurality of first electrodes.

9. A washing appliance according to claim 1, wherein the tank is made of polymeric material, wherein a plurality of first electrodes are co-injected in the wall of the tank.

10. A washing appliance according to claim 1, wherein the information provided by the sensor is used for assessing one or more parameters comprised in the group consisting of amount of detergent in wash and/or rinse water, soil amount in the wash water, wash activity of the wash water, rinse efficiency, suds and foams occurrence, and level of the wash water, these parameters being used for controlling and optimizing the wash program.

11. A washing appliance according to claim 1, wherein the information provided by the sensor is used to control the discharge pump motor.

* * * * *